United States Patent [19]

Giovannini

[11] 3,986,741

[45] Oct. 19, 1976

[54] SECURITY APPARATUS FOR DOORS AND THE LIKE

[76] Inventor: Mario G. Giovannini, 9 Mechanic St., Seneca Falls, N.Y. 13148

[22] Filed: Dec. 5, 1975

[21] Appl. No.: 638,017

[52] U.S. Cl. ..... 292/268; 292/259 R; 70/93

[51] Int. Cl.[2] ..... E05C 17/04

[58] Field of Search ..... 292/270, 259, 268, 260, 292/262, 142, 269; 70/93

[56] References Cited

UNITED STATES PATENTS

| | | | |
|---|---|---|---|
| 741,673 | 10/1903 | Kalb et al. | 292/269 |
| 2,407,900 | 9/1946 | Paul | 70/93 |
| 3,458,226 | 7/1969 | Carlston | 292/268 |
| 3,806,179 | 4/1974 | Roessle | 292/259 |

*Primary Examiner*—Richard E. Moore
*Attorney, Agent, or Firm*—Martin LuKacher

[57] ABSTRACT

Apparatus is described which is mountable on a door and across a doorway for securing the door in closed condition as well as in partially open condition. The apparatus includes a keeper which is adapted to be mounted on a door jamb along one side of the doorway opening. The keeper has a pair of plates one of which is securely fastened to the door jamb and is also pivotally connected to the other plate. The plates are releasably engaged with each other in closed condition. Only when disengaged, the pivotally mounted plate may swing laterally away from the doorway to open position. A bar structure extending across the doorway is pivotally connected to the door jamb on the opposite side of the opening from the keeper, as by being mounted on the same hinge which connects the door to the jamb, so as to swing with the door. The end of the bar opposite to the keeper includes a latch having a bolt which is movable into and out of a slot in the pivotally mounted plate of the keeper. The head of the bolt is larger in width than the width of the slot so that the bolt can not be removed when the keeper is in open condition. When the keeper is in closed position, the bolt may be inserted into the slot in the closed keeper so as to secure the door against any opening. If however limited entry is desired, the keeper may be released so as to permit the pivotal plate to swing into its open position while the bolt limits the extent to which the door may be opened; it being necessary to completely close the door, swing the arm of the keeper back to closed position and withdraw the bolt before the door can be completely opened. A high degree of security is provided both by the keeper structure which forms a box structure of rigid, strong material and also by the bar structure affording the latch which extends across the entire doorway from door jamb to door jamb and also must be advertently operated in order to permit any opening of the door.

6 Claims, 7 Drawing Figures

SECURITY APPARATUS FOR DOORS AND THE LIKE

The present invention relates to security apparatus for providing controlled access to a dwelling and particularly to apparatus for barring a door while providing limited entry therethrough.

The invention is especially suitable for securing a door which swings inwardly to provide access to a dwelling such as a house or an apartment. The apparatus is useful to bar and guard the door while also permitting limited entry into the secured dwelling.

Most commonly used for providing additional security over and above a door lock and latch set, is the chain latch and keeper combination. The chain latch is mounted on the door jamb while the keeper is mounted nearby, on the door. The combination affords no protection when the door is closed, and very limited protection when the door is partially open. If for example, the door lock and latch is jimmied, the intruder may easily remove the latch from the keeper through the use of a bent coathanger or other snake. The chain and its mounting can also be readily ripped from the door jamb by a more aggressive intruder who throws his weight against a partially opened door and applies a snapping force to the chain. Somewhat greater security may be afforded by means of swing arms which are mounted on the door jamb and assist in holding the door latch in closed position. Reference may be had to the following U.S. Patents for such swing arm devices: Pat. Nos. 819,870; 1,524,088; 1,548,270; and 1,673,189. A higher degree of security than is provided by such swing arm devices, which nevertheless is of low cost and is easy to install on a door and door frame, is much desired.

It is an object of this invention to provide improved security apparatus for controlling access into an area equipped with a door or other pivotally mounted structure.

It is a further object of the invention to provide improved security apparatus for controlling access into an area through a door, which apparatus provides a double degree of security in that advertent opening of a plurality of latches is required to permit the opening of the door.

It is a still further object of the present invention to provide improved security apparatus for guarding a door which bars the entire doorway when the door is closed, as well as when limited access is permitted as when the door is partially open.

It is a still further object of the present invention to provide improved security apparatus for guarding a door which also permits the door to be opened to a limited extent while providing protection against opening, both while the door is completely closed and while the door is in partially open condition.

It is a still further object of the present invention to provide improved security apparatus for guarding a door which may readily be manufactured at low cost and also is easy to install.

Briefly described, security apparatus provided in accordance with the invention includes keeper and latch means which may readily be installed in a doorway opening. The keeper may be installed on one side of the doorway as upon the door jamb and includes a pair of members, the first of which may be installed securely on the jamb while the second is pivotally mounted on the first member so as to be movable from a first position in engagement with the first member by means which releaseably hold the members in engagement with each other. The second member has a transverse opening facing the open side of the door which receives the latch means. The latch means is preferably in the form of a bar mounted at one end on a door hinge and having a movable element, such as a bolt which enters into the opening into the pivotally mounted keeper member into latching engagement therewith. Double security is provided since both the keeper members and the bolt in the latch bar must be released in order to open the door. A high degree of strength and rigidity is provided by the inter-engaging members of the keeper. The entire doorway is barred, both when the door is closed and when the keeper member is pivotted to open position to allow the latch bar bolt to move in the keeper member opening, and to permit the door to be opened to a limited extent.

The foregoing and other objects and advantages of the invention as well as a preferred embodiment thereof will be more fully understood from a reading of the following description in connection with the accompanying drawings in which.

Figure 1:
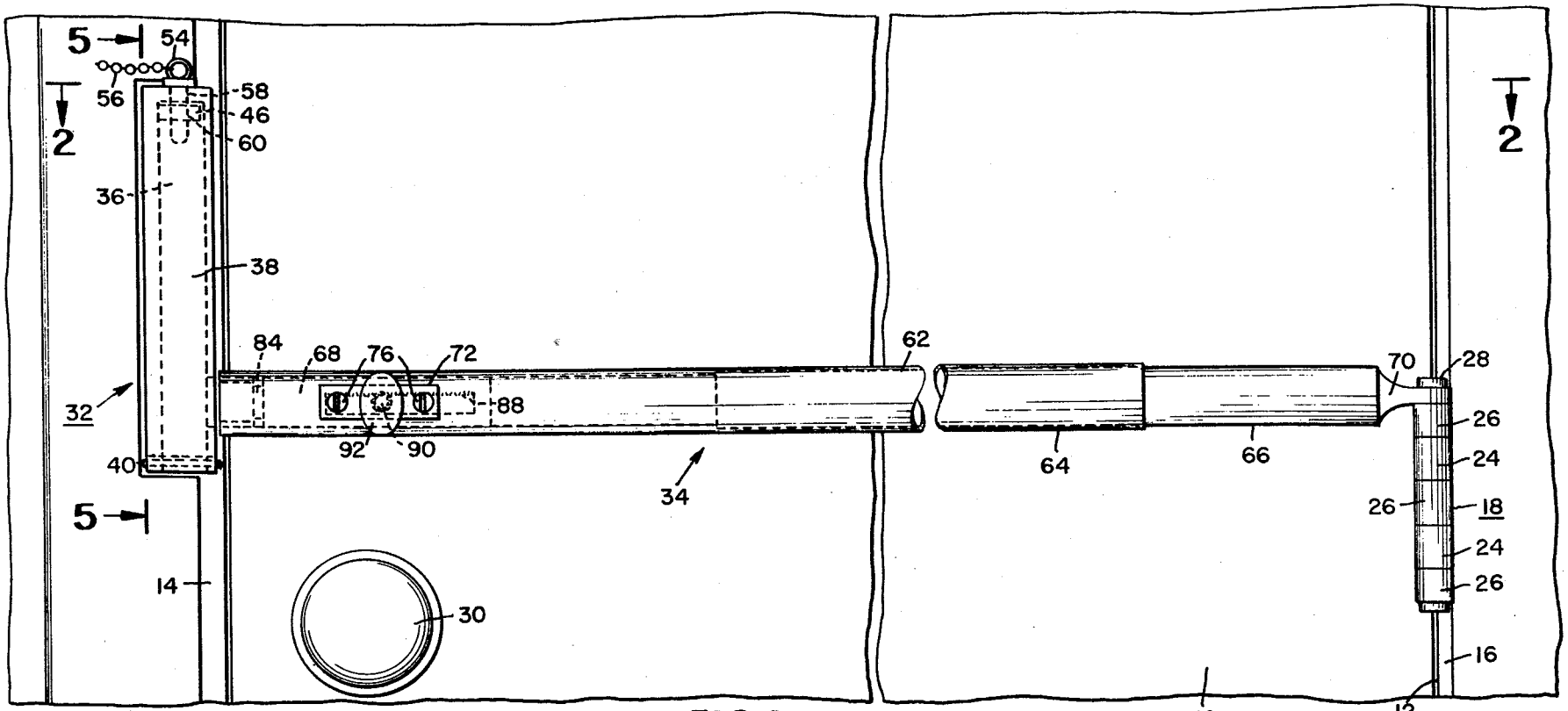
FIG. 1 is a fragmentary view, in elevation, of a door structure equipped with security apparatus embodying the invention.

Referring more particularly to the drawings, there is shown a door 10 in a doorway opening 12. The opening is defined by door jambs 14 and 16 on opposite sides of the doorway. The door 10 swings inwardly into the area being secured (e.g., a house or an apartment) on hinges 18, one of which is illustrated in the drawings. The hinges 18 have hinge plates 20 and 22 which are fastened, as by screws in the right door jamb 16 and in the right edge of the door 10. The hinge plates 20 and 22 have interlocking rings 24 and 26, respectively, through which a pin 28 extends. The door is equipped with a door knob 30 which operates a door latch and is equipped with a lock-set, if desired. The latch and lock set is not illustrated to simplify the drawings.

The security apparatus provided by the invention is adapted to be installed in the aforedescribed type of door structure. The principal parts of this apparatus are a keeper mechanism 32 and a latch mechanism 34 which cooperate with each other. The keeper mechanism 32 is provided by a first or bracket member 36 and a second member 38 which is pivotally mounted to the first member 36 at a pivot 40 provided by a pin or hinge (see FIGS. 5 and 6). The first member is U-shaped having a central section 42 which may be installed in the door jamb 14 by means of screws or other fastening devices. If greater strength and rigidity is desired, the width of the keeper member may be increased and additional screws may be used which extend into the stud 44 which makes up the door frame. In the event that the frame is made out of metal rather than wood as indicated, it is desirable to use toggle bolts or screws to secure the keeper member 36 in the door frame or jamb.

Extending from the central section 42, outwardly away from the door jamb, are upper and lower arms 46 and 48. The pivot pin or hinge 40 is located in the lower arm and extends through the lower end of the pivotal member 38. The member 38 is also in the form of a bracket having a central section 50 and an upper arm 52 which extends generally perpendicular to the central section 50. A side member 54 extends from the upper arm 52 to the lower end of the member 38 where it is pivoted to the first member 36. The side member 54 has a longitudinal opening in the form of a slot 56 which extends between the upper and lower ends thereof. The pivotally mounted member 38 thus forms a box structure which is closed on at least three sides by the upper arm 52, the central section 50 and the side member 54.

Figure 2:
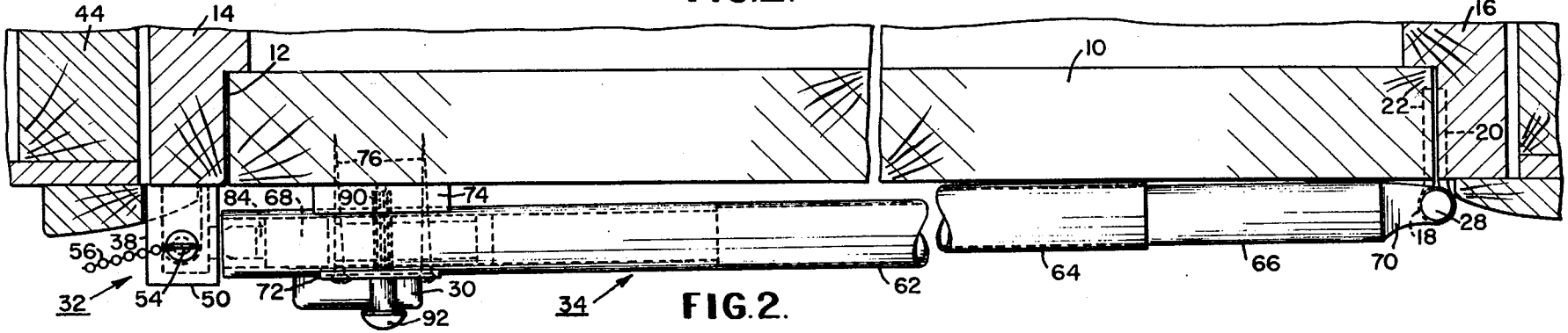
FIG. 2 is a sectional view of the apparatus shown in FIG. 1, the section being taken along the line 2—2 in FIG. 1.
Figure 3:
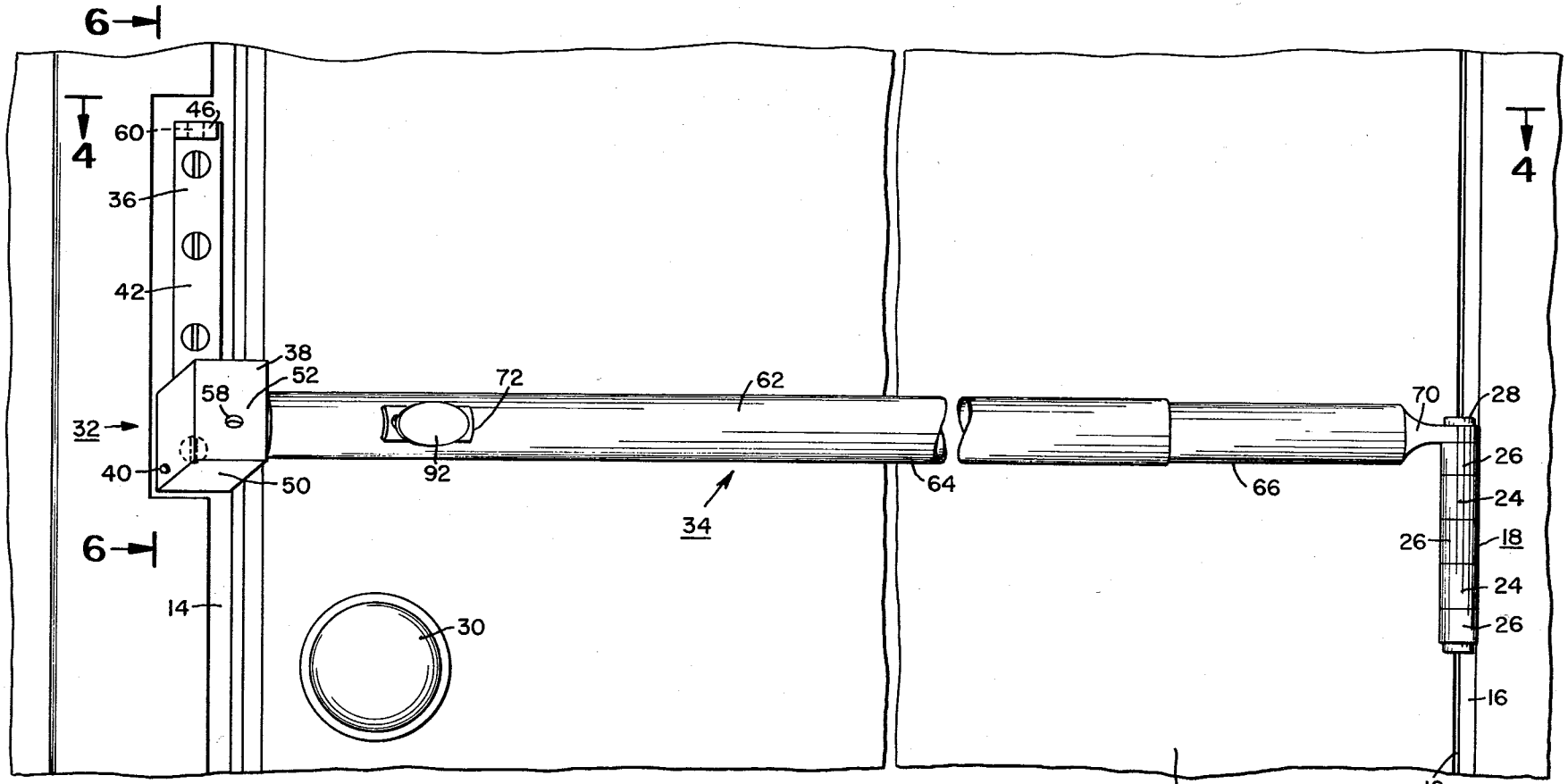
FIG. 3 is a view similar to FIG. 1 showing the apparatus with the door in partially open position.
Figure 4:
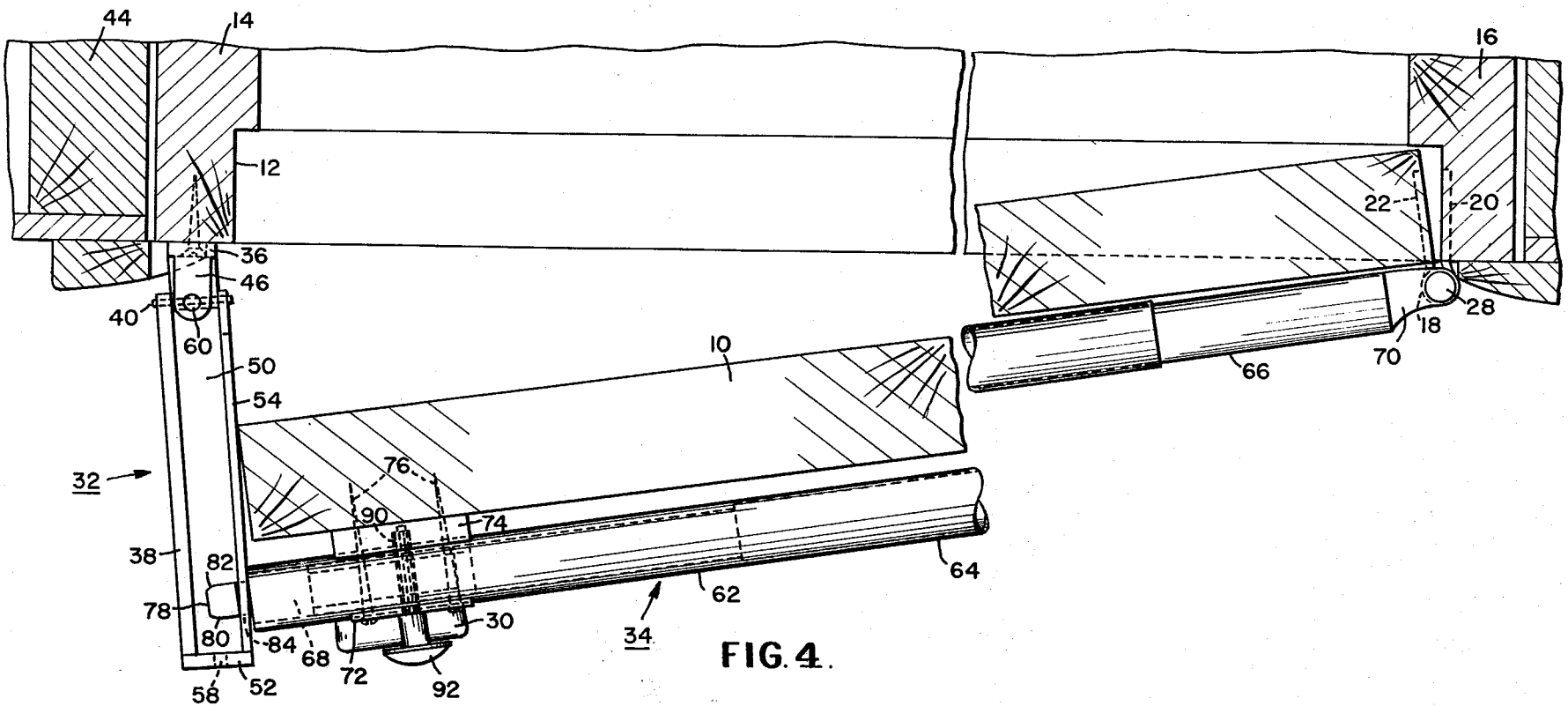
FIG. 4 is sectional view of the apparatus shown in FIG. 3; the section being taken along the line 4—4 in FIG. 3.
Figure 6:
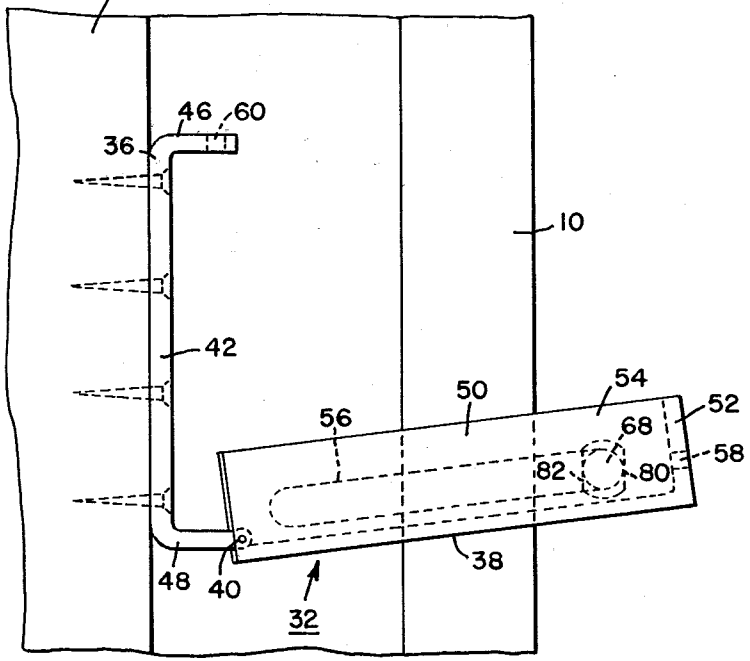
FIG. 6 is a fragmentary view similar to that of FIG. 5, but with the door in partially open position; the view being taken along the line 6—6 in FIG. 3.
Figure 5:
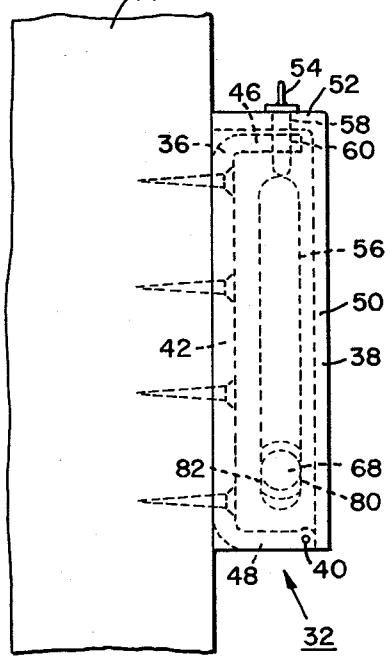
FIG. 5 is a fragmentary side view of the apparatus shown in FIG. 1, the view being taken along the line 5—5 in FIG. 1.

The member 38 is pivotally movable about the hinge or pin 40 between a closed position as shown in FIGS. 1, 2 and 5, where the upper arm is against the door jamb 14, and an open position, as shown in FIGS. 3, 4 and 6, where the member 38 is pivoted away from the jamb. In the open position, the pivotal member is held by the latch mechanism 34 as will be explained more fully hereinafter.

In the closed position the upper arms 46 and 52 of the members 36 and 38 are in engagement with each other and are releasably held in such engagement by means of a latch afforded by a removable pin 54. The pin 54 may be attached to the door jamb by means of a chain 56. The pin 54 may, alternatively, be an integral part of the pivotal arm 38 and may be in the form of a spring biased member. The pin 54 is received in holes 58 and 60 in the arms 52 and 46 and held there by gravity until extracted. If a spring bias release pin is used, then the pin is pulled up against the bias in order to remove it from the hole 60 in the arm 46. The members 38 and 36 are therefore in engagement with each other when the keeper 32 is in closed condition, and held in engagement until advertently released by extracting or otherwise releasing the pin 54. When in closed condition, the members 36 and 38 provide a rigid box-like structure of great strength which is difficult if not impossible to remove from the doorway without exerting an extreme amount of force of the order of magnitude necessary to break down the door.

Figure 7:
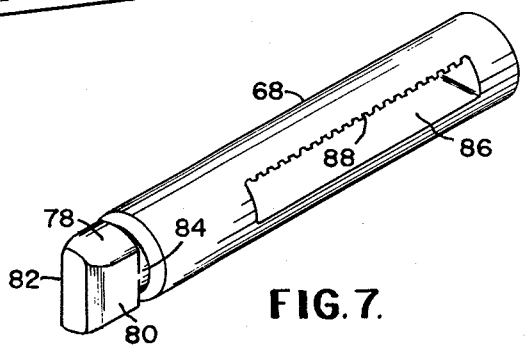
FIG. 7 is a perspective view showing the bolt or movable part of the latch means used in the apparatus shown in FIGS. 1 through 6.

The latch mechanism is provided by a bar 62 made up of a pair of tubes 64 and 66 which are in telescoping relationship so as to permit expansion in size to fit various door widths. A latching member in the form of a bolt 68 (see FIG. 7) is movably mounted in the free end of the tube 64. The tube 66 has an eyelet 70 at its far end through which the pin 28 of the hinge 18 may be inserted thereby readily connecting the bar 62 to the door in a manner where it swings with the door and yet is firmly and securely fastened to the door jamb 16. Somewhat greater rigidity and strength may be provided in this connection between the eyelet 70 and the hinge 18 by removing one of the rings 24 or 26 and replacing it with the eyelet. Thus, the bar 62 may be disposed centrally of the hinge 18. A bracket plate 72 is used to connect the end of the bar 62 to the door 10 by way of a block 74 through which screws 76 extend into the door 10. The block 74 is of sufficient thickness so as to align the bolt 68 with the slot 56 in the keeper 32, when the door is closed.

The bolt 68 has a head 78 which is flattened on opposite sides 80 and 82 which are parallel to the plane of the door 10. A groove 84 is located behind the head 78 and has a diameter approximately equal to the width of the slot 56.

An opening 86 in the bolt 68 is provided with a rack gear 88. A pinion gear 90 which is rotatable by means of a knob 92 engages the rack gear 88 for moving the bolt forward and away from the keeper 32.

With the keeper in closed position (FIG. 5), the knob 92 may be turned and the bolt may be entered or withdrawn from the slot 56 in the keeper member 38, since the width of the bolt as measured between the flat sides 80 and 82 is approximately equal to the width of the slot 56. Sufficient clearance is of course provided, and the forward end of the head 78 of the bolt 68 may be tapered so as to facilitate entry of the bolt into the slot 56 of the keeper. When, however, the pin 54 is released and the door 10 is open the bolt head 78 remains in the keeper and can not be withdrawn since the head of the bolt is of greater diameter than the slot 56. The door moves to partially open position as shown in FIGS. 3, 4 and 6. The extent of opening is limited by engagement of the end of the slot 56 with the bolt 68. Since the knob 92 can not be turned with the door in partially open position, it is not possible to completely open the door unless and until the door is first closed and the keeper members 36 and 38 are latched. Then, the knob 92 may be turned and the bolt 68 extracted from the slot 56 of the keeper 32. The door may then be opened in the usual way.

It may be desirable to equip the knob 92 with a lock set which extends through the door to the front thereof and which may be opened and turned by means of a key. In such case it may be unnecessary to equip the door with further latch and lock sets.

It will be noted that the pivotal keeper member 38 is disposed at a slight angle to the plane of the doorway so as to accommodate for the arc through which the bolt 68 moves. Sufficient clearance may be provided in the groove 84 to accommodate the slight distance between the chord and the arc movement of the bolt 68 defined by the limited opening of the door which is permitted by means of the keeper mechanism 32.

From the foregoing description it will be apparent that there has been provided improved security apparatus for controlling access to a dwelling by way of a doorway and through a door. Variations and modifications in the disclosed apparatus will undoubtedly suggest themselves to those skilled in the art. For example, the keeper mechanism may be made from plates as shown which are suitably welded or soldered, or the keeper mechanism may be a casting suitably machined to define the slot in the pivotal member thereof. Accordingly, the foregoing description should be taken as illustrative and not in any limited sense.

I claim:

1. Security apparatus for controlling access into an area through an opening into said area which is adapted to be closed by a pivotally mounted structure, said apparatus comprising keeper means adapted to be mounted adjacent said opening, latch means adapted to be mounted on said structure and releasably engageable with said keeper means for selectively barring access to said area, providing limited access to said area by enabling limited pivotal movement of said structure to partially open position, and providing complete access to said area when released from said keeper means, said keeper means comprising a first member mountable adjacent said opening, a second member pivotally mounted on said first member at one end thereof and being movable between open and closed position, the end of said second member opposite from said one end being in engagement with said first member when said second member is in closed position, means for releasably holding said second member and said first member in engagement with each other in said closed position, and said second member having a transverse opening therein extending between said one end and said opposite end of said second member, said latch means comprising a third member mounted on said structure and laterally movable into and out of said transverse opening, said third member when disposed in said transverse opening being in engagement with the sides of said transverse opening when said second member is in said closed position thereby preventing pivotal movement of said structure and barring access to said area, said third member when disposed in said transverse opening being in engagement with the end of said opening adjacent said one end of said second member when said second member is in said open position thereby enabling the limited pivotal movement of said structure, and said third member when disposed out of said transverse opening releasing said structure for pivotal movement to enable complete access into said area, and said latch means further comprises a bar mounted pivotally in the side of said opening opposite to the side thereof where said keeper means is mounted so as to be pivotally movable conjointly with said structure, said third member being mounted in said bar for movement in a direction along the longitudinal axis of said bar.

2. The invention as set forth in claim 1 wherein said structure is a door mounted on a hinge disposed on said opposite side of said opening, said hinge having a pin, said bar having an opening through which said pin extends for pivotally mounting said bar.

3. The invention as set forth in claim 2 wherein said bar is tubular at least the end thereof adjacent to said keeper means, said third member is a bolt disposed in said tubular end of said bar, and means coupled to said bolt and extending externally of said bar for movement of said bolt along said longitudinal axis of said bar into and out of said second member opening.

4. The invention as set forth in claim 3 wherein said bolt has a lateral dimension greater than the distance between the sides of said opening and extends beyond the surface of said second member which faces said bar, said bolt being grooved for receiving the sides of said opening whereby said bolt is prevented from being retractably moved out of said keeper when said second member is in said open position.

5. Security apparatus for controlling access into an area through an opening into said area which is adapted to be closed by a pivotally mounted structure, said apparatus comprising keeper means adapted to be mounted adjacent said opening, latch means adapted to be mounted on said structure and releasably engageable with said keeper means for selectively barring access to said area, providing limited access to said area by enabling limited pivotal movement of said structure to partially open position, and providing complete access to said area when released from said keeper means, said keeper means comprising a first member mountable adjacent said opening, a second member pivotally mounted on said first member at one end thereof and being movable between open and closed position, the end of said second member opposite from said one end being in engagement with said first member when said second member is in closed position, means for releasably holding said second member and said first member in engagement with each other in said closed position, and said second member having a transverse opening therein extending between said one end and said opposite end of said second member, said latch means comprising a third member mounted on said structure and laterally movable into and out of said transverse opening, said third member when disposed in said transverse opening being in engagement with the sides of said transverse opening when said second member is in said closed position thereby preventing pivotal movement of said structure and barring access to said area, said third member when disposed in said transverse opening being in engagement with the end of said opening adjacent said one end of said second member when said second member is in said open position thereby enabling the limited pivotal movement of said structure, and said third member when disposed out of said transverse opening releasing said structure for pivotal movement to enable complete access into said area, and said structure being a door and said opening being defined by a jamb, said keeper means first member being a first bracket of U-shape having a central section and upper and lower arms extending generally perpendicular thereto, said central section being secured to said jamb and said arms extending outwardly from said jamb in the direction of pivotal movement of said door into said area, said second member being a second bracket having a central section and an upper arm extending generally perpendicular thereto, said second bracket also having a side member extending generally perpendicular to the central section thereof between said upper and the lower end of said central section and being attached thereto to form a box-like structure closed on at least four sides, said four sides being formed by said upper arm, said lower arm, said central section and said side member, respectively;

a hinge connected to said first and second bracket lower arms for pivotally mounting said second brackets to said first bracket, said upper arms of said first and second brackets being disposed in overlapping relationship when said second bracket is pivoted toward said first bracket to bring them into said closed position, keeper latch means mounted on said first bracket upper arm for releasably holding said first and second brackets in said closed condition, and said opening being provided by a slot in said side member extending between said upper and lower arms.

6. The invention as set forth in claim 5 wherein said door is pivotally mounted on a second jamb on the opposite side of a doorway which defines the opening into said area, a plurality of hinges providing the pivotal mounting for said door, said hinges including pins, said latch means including a bar having an eyelet at one end and a bolt movably axially thereof at the opposite end, the pin of one of said hinges extending through said eyelet for pivotally mounting said bar to swing with said door, said side member of said second bracket having an opening, and said bolt being movable into and out of said opening.

* * * * *